US007546845B2

(12) United States Patent
Prusmack

(10) Patent No.: US 7,546,845 B2
(45) Date of Patent: Jun. 16, 2009

(54) DOUBLE TANG DESIGN ARTICULATING HUB ASSEMBLY

(75) Inventor: A. Jon Prusmack, Valley Cottage, NY (US)

(73) Assignee: DHS Systems LLC, Orangeburg, NY (US)

( * ) Notice: Subject to any disclaimer, the term of this patent is extended or adjusted under 35 U.S.C. 154(b) by 190 days.

(21) Appl. No.: 11/228,651

(22) Filed: Sep. 15, 2005

(65) Prior Publication Data

US 2007/0056618 A1 Mar. 15, 2007

(51) Int. Cl.
*E04H 15/32* (2006.01)
*E04H 15/28* (2006.01)
*E04H 15/26* (2006.01)

(52) U.S. Cl. ..... 135/120.3; 135/98; 135/99; 135/135; 135/147

(58) Field of Classification Search ..... 135/135, 135/147, 159, 30, 28, 136, 144; 403/217, 403/218

See application file for complete search history.

(56) References Cited

U.S. PATENT DOCUMENTS 5,454,661 A * 10/1995 Litvin et al. ..... 403/298
5,678,586 A * 10/1997 Baksh ..... 135/33.7
5,797,695 A * 8/1998 Prusmack ..... 403/170
D544,941 S * 6/2007 Rogers ..... D21/839

* cited by examiner

*Primary Examiner*—David Dunn
*Assistant Examiner*—Danielle Jackson
(74) *Attorney, Agent, or Firm*—Thomas A. Beck

(57) ABSTRACT

A double tang articulating hub assembly used in combination with a collapsible self-supporting structure. The double tang articulating hub assembly is used as a connector among tubular rod elements which together provide a generally tubular frame matrix used to erect a collapsible self-supporting prefabricated deployable structure where a clear span interior without supporting columns is required. The hub employs a plurality of one piece "forked plugs" each containing a cylindrical plug with two tangs and an integral post connecting the tangs allowing the forked plug to rotate.

10 Claims, 5 Drawing Sheets

DOUBLE TANG DESIGN ARTICULATING HUB ASSEMBLY

FIELD OF THE INVENTION

The present invention relates to a double tang design articulating hub assembly used as a connector among tubular rod elements comprising the frame matrix for collapsible self-supporting prefabricated structures requiring clear span interiors with no supporting columns.

BACKGROUND OF THE INVENTION

Hub assemblies have been used in the construction of exhibit display stands and dome-like structures such as geodesic domes. For maximum utility, designs which minimize the number of small parts, minimize part count, minimize the number of free components when disassembled, and maximize the stiffness are particularly valuable.

U.S. Pat. No. 3,968,808 discloses a collapsible self-supporting dome-like structure with a network of pivotal rods interconnected with linking joints. The linking joint holds six rods, each connected to a six-sided metal ring. Each rod is connected onto the ring and is capable of rotating. The rod is a permanent attachment and thus cannot be disconnected nor replaced. There does not appear any way to attach a cover to the dome-like structure such as is found in the "keeper" component in the articulating hub assembly of the present invention.

U.S. Pat. No. 4,026,313 also discloses a collapsible self-supporting dome-like structure with a network of pivotal rods interconnected with linking joints. The pivotal device linking the rods together forming the structure is a circular joint. Each joint has only four rods. Each rod contains a plug ending with a small cylinder. This small cylinder is nested inside the joint and allows the rod to rotate. It appears that none of the components is easily interchanged. The top and bottom sections of the hubs in the reference appear to be permanently joined by an adhesive so that none of the rods or plugs can be replaced.

U.S. Pat. No. 4,512,097 discloses a display panel mounting clip. The clip body is used to connect display panels together. The clip assembly disclosed requires a spring mechanism to create tension and hold the panels together. The present invention requires no springs. The clip disclosed in the reference must be snapped into an opening joining the rods in a circular joint. In the present invention, the keeper is screwed into the hub body so it is threadedly secured.

U.S. Pat. No. 4,280,521 discloses a hub assembly for collapsible structures. The hub assembly disclosed in the reference requires a circular retaining ring to hold the "column like elements" or tubes in place. Each tube must be threaded onto a circular retaining ring prior to insertion into the hub section. The hub sections are secured in place by use of an adhesive to fuse the two hub sections together permanently. The tube members within the structure, therefore, are not easily replaceable since the hub sections cannot be replaced without destroying them. The reference design uses a three piece clamping device to hold or attach a skin or cover to the structure. One piece is a plug that is incorporated inside the hub section and is fused into the hub sections. The second piece is a flat disc. The third piece is an element which is a screw. The screw is threaded into the plug and holds the clamp down. A screw driver would obviously be required to remove the clamp if the cover, the skin or the tubes have to be replaced.

In the present invention no circular ring is present or required to hold the rods together inside the hub, reducing the number of components. In addition, a screwdriver is not required to disassemble the present invention. Further, the design taught by '521utilizes a single tang design. Single tang designs are inherently flexible, an issue addressed by the present invention. Further, the reference design does not provide a means to restrict rotation of the tubes that connect to the hub assembly without the use of an adhesive or other welding method. In the present invention an adhesive is not required.

U.S. Pat. No. 5,797,695 also discloses a hub assembly for collapsible structures. The hub assembly disclosed in the reference employs a design comprised of a single tang connected to a separate plug. This design secures the tube to the body of the hub assembly with an assembly consisting of a plug, tang, roll pin and rivet, presenting the user with four small, easily misplaced, and damaged parts at each tube position. The reference assembly provides for eight positions, thus users must account for 32 such parts in total when repairing to assembling the assembly or structure.

The single tang design also permits the plug and attached tube to bend in the direction perpendicular to the plane of the tang, an undesirable feature when the hub assembly is used in collapsible structures. Lateral weakness results because a single tang design requires the tang to resist bending forces in its weakest direction, making the tang susceptible to forming a permanent bend or fracture, an undesirable failure mode addressed by the present invention. Also, in the '695 design, the position of the tang along the roll pin is not fixed, resulting in bending when mispositioning of the tang on the roll pin occurs, an issue addressed in the present invention. Finally, the hub assembly disclosed in the reference employs a rivet in the side wall at the end of each tube to secure the tang's tail to the plug and tube. The rivet is a small, easily misplaced part that requires special tools for removal and replacement in the event repair is required and holes in the side wall of the ends of the tubes must be provided to accept the rivet. The hole in the side wall of the tube weakens the tube, making the tube more susceptible to failure than tubes used with the present invention. Provision of said holes requires the availability of additional special tooling to effect a field repair or the availability of application-specific tubing with holes provided.

SUMMARY OF THE INVENTION

The present invention relates to an articulating hub assembly suitable for use in collapsible structures. The hub assembly consists of a hub body having a periphery, a central threaded opening therethrough and a plurality of paired radial slots extending inwardly from the periphery of the hub body, each pair of said radial slots in the hub body having a discontinuous groove located perpendicular thereto. The hub body also possesses a series of openings extending through the hub body, with the openings being positioned radially between each of the radial slots and between the periphery and the central opening of said hub body.

The assembly also has a hub cover having a periphery, a central opening therethrough, a plurality of paired radial slots and a series of openings extending through the hub cover, the hub body and the hub cover being assembled contiguously so that at the central opening, the paired radial slots and the openings of the hub cover are in registry with the central opening, the paired radial slots and the openings of the hub body.

Also in the assembly, there is an integrally formed keeper element having a top and a shaft extending downwardly therefrom, wherein the shaft is capable of being inserted through the hub cover, and the shaft is capable of being secured to the hub body.

The assembly possesses a plurality of forked plugs, each of the forked plugs having a first end and a second end, the first end having a pair of tangs joined by a post, the pair of tangs being positioned in one pair of the radial slots of the hub body and the hub cover in registry therewith, and the post being positioned in the discontinuous groove, the second end having a cylindrical plug comprised of a crown and ribs wherein at least one such rib has at least one shoulder and a structural element is secured to the plug.

Objects and features as well as additional details of the present invention will become apparent from the following detailed description and annexed drawings of the presently preferred embodiments thereof, when considered in conjunction with the associated drawings. The hub assembly of the present invention is a substantial improvement over prior art reference assemblies.

The present invention employs a one piece "forked-plug" comprised of a cylindrical plug with two tangs and an integral post connecting the tangs that allows the forked plug to rotate. The integral post between the tangs also results in a structure that provides unexpectedly high lateral stiffness, a feature particularly desirable for application in collapsible structures. Further the cylindrical plug is ribbed. The ribbed plug enables the plug to grip the inside of the tubes, enabling assemblies that do not employ the adhesives or rivets used in prior art, but still provide secure, non-rotating fastening of the tube to the ribbed plug while allowing disassembly and repair without tools.

The present invention requires no mechanical devices, such as a screwdriver, to disassemble or assemble the hub assembly, and adhesives are not required.

BRIEF DESCRIPTION OF THE DRAWINGS

The invention will now be described in greater detail in the following description of the preferred embodiments taken in conjunction with the accompanying drawings.

DESCRIPTION OF THE PREFERRED EMBODIMENT

Figure 1:
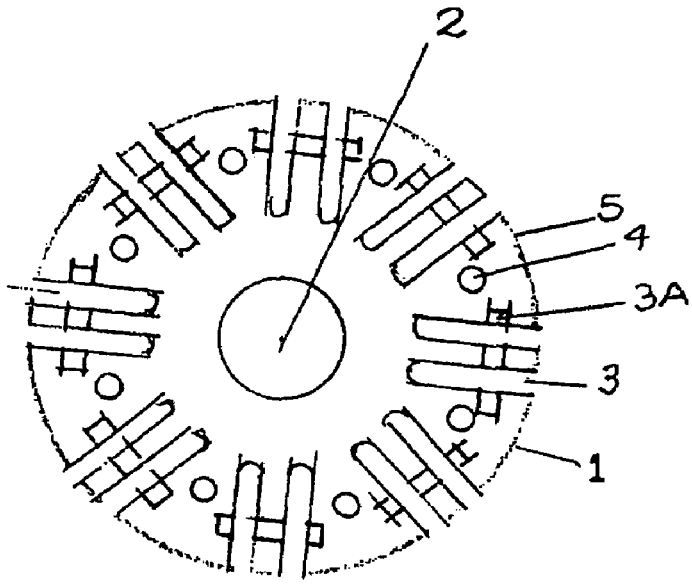
FIG. 1 is a plan view of the of the hub body of the present invention.

The articulating hub assembly of the present invention comprises a novel means for pivotally joining a network of tubes forming the matrix for a collapsible deployable structure. Multiple assemblies are used as pivotal devices for the movement of tubes to allow the quick erection and striking of a tubular frame supported structures.

A first significant feature of the present invention is to allow the tubes to articulate or move when either upward, i.e., vertical, or opposing side, i.e., horizontal, forces are applied.

More specifically, with respect to a collapsed network of tubes, assemblies, etc. laid out prior to erection, when manual upward pressure is applied at 90°.(i.e., perpendicular) to the ground at specific locations on the network, multiple hub assemblies are displaced from positions physically contacting the ground to specific elevated positions above the ground. The upward vertical force creates an action that moves the articulating hub assemblies of the present invention from static positions to tension positions and forms a structure of interconnected tubes and articulating hub assemblies that is self supporting. The resultant structure has five physical sides; the two ends, two sides and the top. The size and the shape of the structure can vary based upon the length of the tubes and the location of the scissor points.

To collapse the frame to its original position on the ground, simultaneous and opposing forces are applied on each of the four sides of the structure, (to the ends and to the sides) 180° to each other and 90° to the vertical (along the 0 or X-axis), to specific articulating hub assemblies.

This action allows the tubular frame to move from a tension position with the assemblies above ground, back to a static position and collapse down to the original location on the ground.

A second significant feature of the articulating hub assembly of the present invention is the ability to secure a fabric cover (covering the tubular frame network) to the hub body and allow the cover to move simultaneously with the tubular frame. The mushroom shaped threaded "keeper" component is inserted through an opening in the cover and screws into the hub body. This arrangement semi-permanently fixes and secures the fabric cover to the tubular frame. In this manner the frame and cover produce a quickly-erected fabric-covered shelter.

The third significant feature of the present invention is that all components are interchangeable.

A fourth significant feature of the present invention is its ability to grip the ends of tubes without the use of an additional fastener thereby avoiding the need for a hole or other feature in the side wall of the tube to accept a fastener while permitting repair of tubes.

A fifth significant feature of the present invention is that the forked-plug is one piece, facilitating handling in the field and mitigating the risk small parts may be lost during a field repair.

A sixth significant feature of the present invention is that the forked-plug provides high lateral stiffness enabling lighter weight, more robust or lower production cost for the collapsible structures.

A seventh significant feature of the present invention is that it grips the tubes such that they cannot rotate freely, resulting in stiffer collapsible structures.

The body of the hub assembly is depicted in FIG. 1. The hub body 1 is a disc-like unit having a central opening 2 therethrough and a series of radial slots 3 extending inwardly from the periphery of disc 1 having a series of openings 4 extending through disc 1 and positioned radially between each of the radial slots 3 and between periphery 5 and central opening 2, the surface of which is threaded. A groove 3A is located perpendicular to each of radial slots 3.

Figure 2:
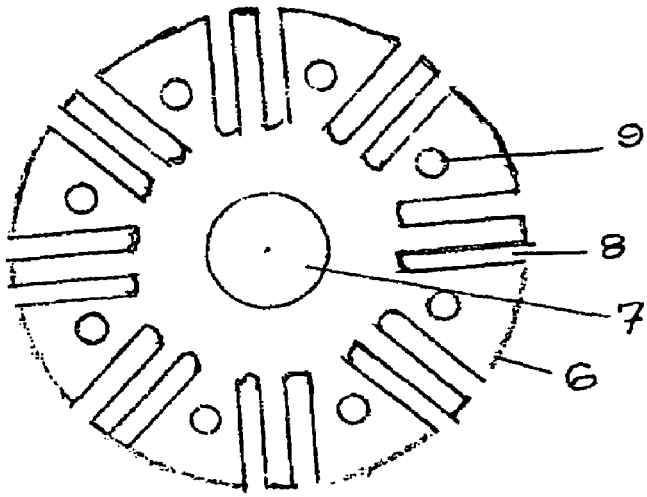
FIG. 2 is a plan view of the hub cover of the present invention.

The cover of the hub assembly is depicted in FIG. 2. The hub cover 6 is a disc like unit having a central opening 7, radial slots 8, and openings 9. The hub body 1 and hub cover 6 are assembled contiguously so that central openings 2 and 7, radial slots 3 and 8, and openings 4 and 9 are in registry.

Figure 3:
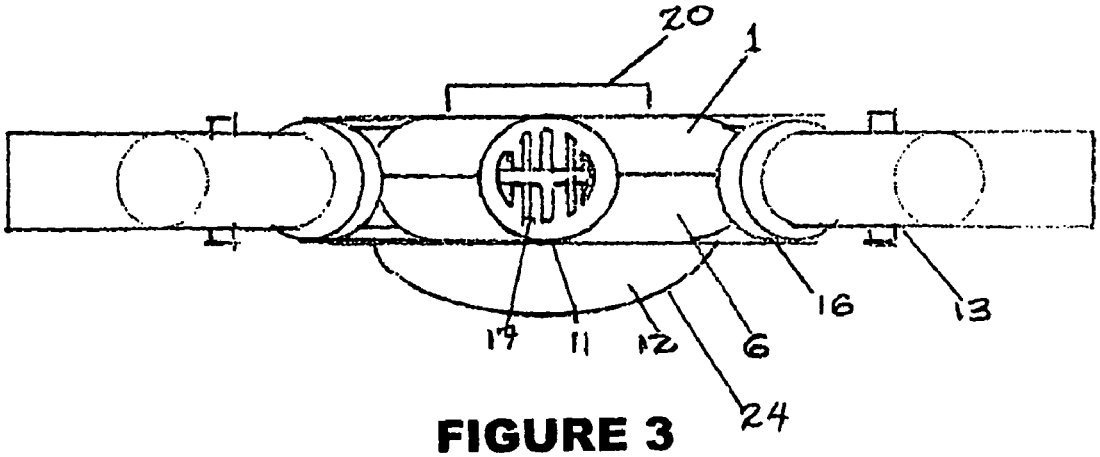
FIG. 3 is a side view of the articulating hub assembly of the present invention.

FIG. 3 is a side view of the articulating hub, assembly. Mechanically captured by the hub body and hub cover are the forked-plugs 13. The assembly is threadedly secured by keeper 12 wherein the shaft of the keeper is threaded and has a diameter and thread that coincides with the diameter and thread present in central opening 2, and possesses a diameter less than that of central opening 7, enabling the shaft of the keeper to pass through the hub cover and threadedly engage the hub body, thereby securing the assembly. The keeper is large enough that it can be turned by hand, without the use of tools. It is a mushroom-shaped element such that the exposed top of the keeper 24 is contoured to match the contoured shape of the hub cover. Keepers of any shape may be used. Also shown in FIG. 3 is boss 20 which provides additional strength to the hub body.

Figure 4:
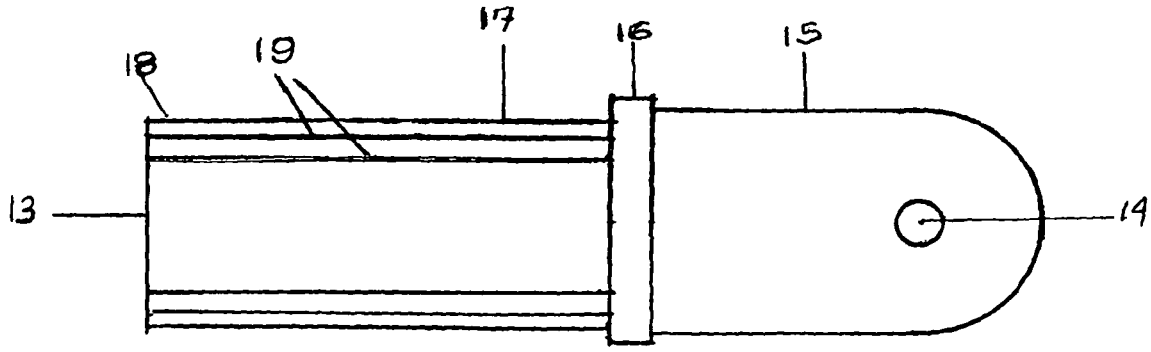
FIG. 4 is a side view of the forked-plug.

FIG. 4 is a side view of forked-plug 13, showing post 14, tang 15, crown 16, and ten retaining ribs 17. Tang 15 is designed to fit within radial slots 3 and 8 and post 14 is designed to fit within groove 3A. Tang 15 possesses substantially the same thickness as the width of slots 3 and 8 and post 14 possesses an exterior dimensions substantially the same as the interior dimensions of groove 3A. Further the distance between post 14 and crown 16 is greater than the dimension between groove 3A and the periphery of the hub body ensuring the forked-plug may pivot freely within the hub-assembly. Also shown in FIG. 4 is central rib 18 which is provided with four shoulders 19.

Figure 6:
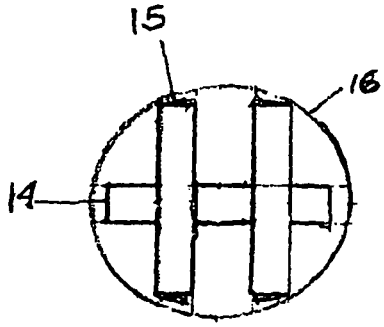
FIG. 6 is an end view of the hub (inner) end of the forked-plug.
Figure 5:
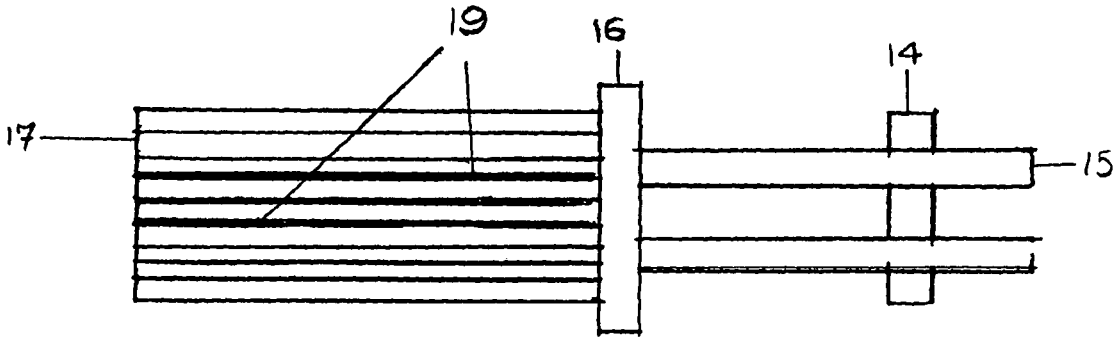
FIG. 5 is a plan view of a forked-plug.

FIG. 5 is a plan view of the forked-plug showing the arrangement of the tangs 15 and integral post 14. The arrangement of the tangs and post are further depicted in FIG. 6. The one-piece double-tang and post design of the forked-plug is substantially different than the prior art and provides lateral stiffness greater than a simple multiple of the single tang designs taught in the prior art. The dramatic improvement in lateral stiffness is possible through the use of the integral post 14 which connects the two tangs of the forked-plug. The one-piece design of the forked plug has the additional benefits of reducing part count and eliminating the need for small parts, such as pins, as is practiced in the prior art.

FIG. 5 also depicts ribs 17 and shoulders 19 which enable forked-plug to reversibly grip the tubes of a collapsible structure without the use of an adhesive or other fastener, a marked improvement over prior art. The prior art practice of fastener fixed tubes requires the user to also have the requisite tools to operate the fastener, tools that may not be readily available in the field. Alternatively, the prior art practice of fixing tubes with adhesive precludes repair of tubes. Further, the ribs and shoulder prevent the tubes from rotating on the forked-plug, imparting additional stiffness to the resulting structure.

Figure 7:
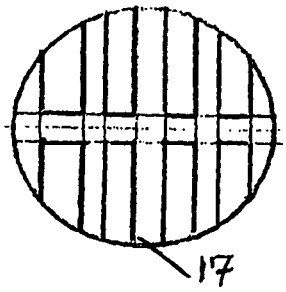
FIG. 7. is an end view of the tube (peripheral) end of the forked-plug.

FIG. 7. depicts an end view of the peripheral end of the forked-plug, including the ribs 17 and shoulders 19. The cross-sectional dimensions of ribs 17 form a cylindrical shape that is substantially the same as the inner diameter of the tube of a collapsible structure. When a tube is slid over the ribs, its travel is stopped by crown 16. Further, the ribs deform slightly, enabling them to accommodate small changes in the inner diameter of the tubes, such as may result from manufacturing inconsistency of the tubes, and allowing the shoulders and ribs to grip the inner surface of the tubes.

Figure 8:
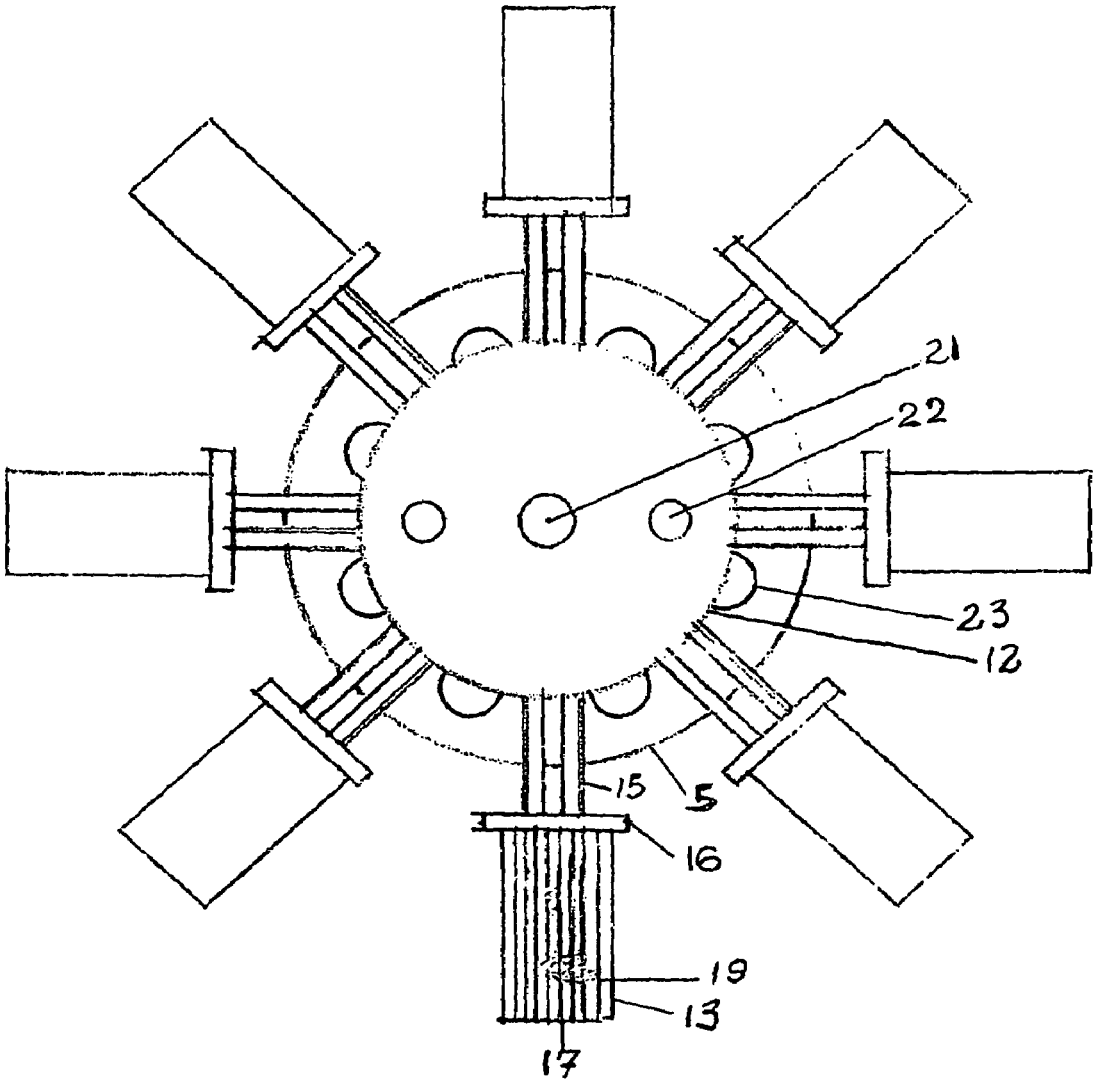
FIG. 8 is a plan view of the articulating hub assembly of the present invention.

FIG. 8 depicts a plan view of the articulating hub assembly, including the keeper, hub cover and forked-plug as described above. In the preferred embodiment the hub assembly is provided with eight forked-plug, as shown in FIG. 8. The keeper is provided with a central well 21 and two peripheral wells 22 for application of torque by means of a tool for the purpose of making the assembly operable by those without sufficient manual dexterity to operate the hub assembly without tools. The hub cover has openings 9 which coincide with registered openings in the hub body.

Figure 9:
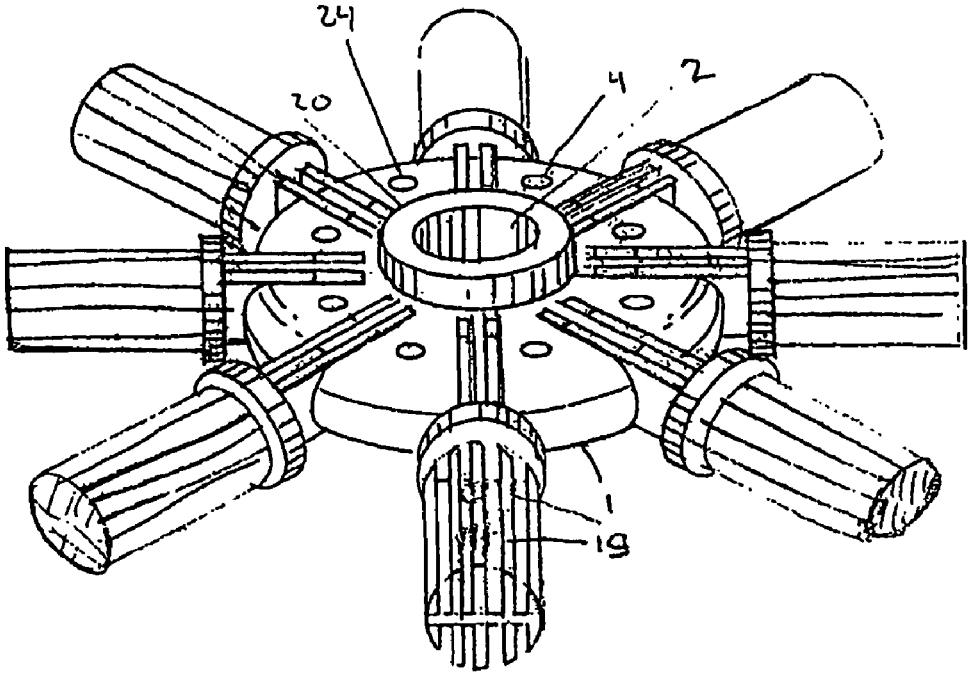
FIG. 9 is a perspective view of the articulating hub assembly of the present invention.

FIG. 9 is a perspective view of the articulating hub assembly of the present invention depicting openings 4 in the hub body and threads on the inner surface of central opening 2. This view does not include the fabric which would cover the collapsible structure. The fabric may be captured by the keeper by inserting the keeper's captured shaft through a hole in the fabric before inserting the keeper's shaft through the hub cover and threading the keeper into the hub body.

All of the components described above are interchangeable. Further, assembly or disassembly of the hub assembly does not require any tools, unlike prior art which required a screwdriver to remove screws that joined hub sections. In addition, tubes may be individually replaced without having to remove the entire collection of tubes before the individual tube in the collection is replaced. As noted above the forked-plug design provides improved stiffness while the ribs and shoulder enable the invention to reversibly grasp tubes while not allowing them to rotate.

Thus while there have been shown, described and pointed out fundamental features of the invention as applied to currently preferred embodiments thereof, it will be understood that various omissions and substitutions and changes in form and details of the method and apparatus illustrated, and in their operation, may be made by those skilled in the art without departing from the spirit of the invention. In addition it is to be understood that the drawings are not necessarily drawn to scale but that the are merely conceptual in nature. It is the intention, therefore, to be limited only by the scope of the claims appended herewith.

What I claim and desire to protect by Letters Patent is:

1. An articulating hub assembly comprising an assembly suitable for use in collapsible structures comprising:

an articulating hub assembly comprising rigid circular shaped mating hub body and hub cover components;

a said hub body having: an upper surface and a lower surface, a periphery, a boss located on said upper surface of said hub body, said boss having an outer periphery, a central threaded opening therethrough within said boss and eight paired slots extending radially inwardly through said hub body from said periphery of said hub body substantially to said outer periphery of said boss, and at each pair of said radial slots located at said lower surface of said hub body having a discontinuous groove located perpendicular thereto, said hub body also having a series of openings extending through said hub body, said hub body openings being positioned between and adjacent to each pair of said radial slots, and between said periphery and said central opening of said hub body;

said hub cover having: an upper surface and a lower surface, a periphery, a central opening therethrough and eight paired slots extending radially inwardly through said hub cover from said periphery of said hub cover substantially to said central opening through said hub cover, and a series of openings extending through said hub cover; said hub cover openings being positioned between and adjacent to each pair of said radial slots, and between said hub cover periphery and said central opening of said hub cover; said upper surface of said hub cover having a continuous plane surface;

said lower surface of hub body and said upper surface of said hub cover being assembled contiguously in axial alignment so that said central opening, said paired radial slots and said openings through said hub cover are aligned and in registry with said central opening, said paired radial slots and said openings of said hub body;

an integrally formed keeper element having a top and a shaft extending downwardly therefrom, wherein said shaft is capable of being inserted through said hub cover and said shaft is capable of being secured to said hub body;

eight forked plugs, each of said plugs having a first end and a second end, the first end having a pair of tangs joined by a post, said pair of tangs being positioned in one pair of radial slots of said hub body and said hub cover in registry therewith and said post being positioned in said discontinuous groove in said hub body, said second end having a cylindrical plug comprised of a crown and ribs wherein at least one such rib has at least one shoulder and a structural element is secured to said plug.

2. The articulating hub assembly defined in claim 1 wherein said hub cover central opening is threaded.

3. The articulating hub assembly defined in claim 2 wherein said keeper shaft is threaded to coincide with the central threaded opening of said hub body and said hub cover to allow said shaft to be threadedly engaged therein.

4. The articulating hub assembly defined in claim 1 wherein said structural element is a tubular structure.

5. The articulating hub assembly defined in claim 4 wherein a cover is atop said tubular structure, said cover being secured in place between said keeper element and said hub cover and said hub body.

6. The articulating hub assembly defined in claim 1 wherein said cylindrical plug is comprised often connected ribs.

7. The articulating hub assembly defined in claim 6 wherein one rib of said cylindrical plug has two shoulders.

8. The articulating hub assembly defined in claim 6 wherein said hub body and said hub cover are circular in shape.

9. The articulating hub assembly defined in claim 6 wherein said top of the keeper element is contoured to match a contoured slope of said hub cover.

10. The articulating hub assembly defined in claim 1 wherein said assembly is made of metal, thermoplastic or thermoset material.

* * * * *